United States Patent [19]

Blythe et al.

[11] Patent Number: 4,621,772

[45] Date of Patent: Nov. 11, 1986

[54] ELECTROMAGNETIC FUEL INJECTOR WITH THIN ORIFICE DIRECTOR PLATE

[75] Inventors: James S. Blythe; Michael J. Dinkel, both of Rochester; Donald D. Stoltman, Henrietta, all of N.Y.

[73] Assignee: General Motors Corporation, Detroit, Mich.

[21] Appl. No.: 730,465

[22] Filed: May 6, 1985

[51] Int. Cl.[4] ..... F02M 51/06

[52] U.S. Cl. ..... 239/585

[58] Field of Search ..... 239/533.12, 585, 590.3; 251/154

[56] References Cited

U.S. PATENT DOCUMENTS

| | | | |
|---|---|---|---|
| 4,057,190 | 11/1977 | Kiwior et al. | 239/585 X |
| 4,218,021 | 8/1980 | Palma | 239/585 |
| 4,413,780 | 11/1983 | Skinner et al. | 239/533.12 X |
| 4,423,842 | 1/1984 | Palma | 239/585 |
| 4,467,966 | 8/1984 | Mueller | 239/533.4 |
| 4,532,906 | 8/1985 | Hoppel | 239/533.12 X |

*Primary Examiner*—Andres Kashnikow

*Attorney, Agent, or Firm*—Arthur N. Krein

[57] ABSTRACT

An electromagnetic fuel injector has a thin orifice director plate, mounted downstream of the orifice passage defined when the solenoid actuated valve of the injector is in the open position relative to its associated valve seat, for controlling static flow from the injector. The thin orifice director plate is provided with upset angled portions having the flow orifice formed at right angles therethrough to direct the jets of fuel flow, as desired, relative to the axis of the spray tip discharge passage of the injector. Preferably, the length (L) to diameter (D) ratio of each flow orifice is 0.5 or less.

3 Claims, 7 Drawing Figures

ELECTROMAGNETIC FUEL INJECTOR WITH THIN ORIFICE DIRECTOR PLATE

FIELD OF THE INVENTION

This invention relates to electromagnetic fuel injectors and, in particular, to such an injector having a thin orifice director plate therein that is located downstream of the solenoid actuated valve of the injector assembly thereof.

DESCRIPTION OF THE PRIOR ART

Electromagnetic fuel injectors are used in fuel injection systems for vehicle engines because of the capability of this type injector to more effectively control the discharge of a precise metered quantity of fuel per unit of time to an engine. Such electromagnetic fuel injectors, as used in vehicle engines, are normally calibrated so as to inject a predetermined quantity of fuel per unit of time prior to their installation in the fuel system for a particular engine.

In one form of electromagnetic fuel injectors such as the type disclosed, for example, in U.S. Pat. No. 4,218,021 entitled "Electromagnetic Fuel Injector" issued Aug. 19, 1980 to James D. Palma, the flow discharge restriction in the nozzle assembly thereof is incorporated into a swirl director plate or disk having a plurality of director flow orifices passages thereof. In such an arrangement, the total flow area of these orifice passages is less than the flow area defined by a valve seat and an associate solenoid controlled valve when in a fully opened position. The multiple flow orifices in parallel used in that swirl director plate are known to be superior in unit-to-unit flow repeatability to an equivalent single orifice plate. However it has now been found in an investigation of calibration setability of such electromagnetic fuel injectors that the source of flow variation among such injector is predominately fluid dynamics. That is, flow or the coefficient of discharge repeatability is characterized by orifice contour, Reynolds Number of the fluid, up and downstream flow conditions, and orifice Length/Diameter ratio.

A multiple orifice director plate of the type shown in the above-identified U.S. Pat. No. 4,218,021 or of the type shown in U.S. Pat. No. 2,382,151 entitled "Fuel Injector", issued Aug. 14, 1945 to William Harper, Jr., is fluid dynamically thick and, accordingly, director plates of this type will exhibit erratic flow response. In addition, since the plume exit vector from each orifice in such an orifice director plate is controlled by the use of relatively long orifices that have poor linearity/-repeatability, the application use thereof is acute due to orifice upstream disturbances. In addition, such multiple orifice director plates on a unit-to-unit basis will normally have flow repeatability characteristics that will vary by 8% or more.

Thin orifice director plates with flow undisturbed or having an orifice axial approach are well known, as disclosed, for example, in U.S. Pat. No. 4,057,190 entitled "Fuel Break-Up Disc for Injection Valve", issued Nov. 8, 1977 to Alexander M. Kiwior and James D. Bode. Although such prior known multiple orifice director plates do have repeatable/linear flow characteristics, all such known thin orifice director plates have the exit plume vector from each orifice flowing normal to the plate and such flow will occur irrespective of the angle of the orifice passage walls through the plate.

SUMMARY OF THE INVENTION

Accordingly, a primary object of the present invention is to provide an improved fuel injector, such as an electromagnetic fuel injector, that advantageously has a thin orifice director plate incorporated therein downstream of the solenoid control valve thereof, and at right angles to the reciprocating axis of the valve, wherein the material of the director plate surrounding each orifice being inclined at a predetermined angle to the axis with each orifice being at right angles to the material whereby the orifice flow passage defined by each orifice defines a circular flow area when viewed in cross-section from the inlet to the outlet side of the orifice.

Another object of this invention is to provide an improved fuel injector, such as an electromagnetic fuel injector, wherein a thin orifice director plate is located downstream of the control valve of the injector and at right angles to the reciprocating axis thereof, and wherein the surfaces of the director plate around each of the plural orifices therethrough is angled relative to the reciprocating axis so as to aim the fuel streams flowing through the orifice, with the length to diameter ratio of the orifices being equal to or less than 0.5.

Still another object of this invention is to provide an injector apparatus of the above type which includes features of construction, operation and arrangement, rendering it easy to manufacture, assemble and to calibrate for desired fuel flow, which is reliable in operation, and in other respects suitable for use on production motor vehicle fuel systems.

The present invention provides an electromagnetic fuel injector having a housing with a solenoid stator means incorporated at one end thereof and an injection nozzle assembly incorporated at the opposite or discharge end thereof. An armature/valve member is reciprocable along an axis relative to a pole piece of the stator means and an associate valve seat to control fuel flow to the injection nozzle assembly. The injection nozzle assembly includes a thin orifice director plate that is positioned at right angles to the axis but which has portions thereof surrounding each of the plural orifice passages located concentrically about the axis angled relative to the axis so as to aim the fuel streams at an angle to the axis, with the length to diameter ratio of the orifices being equal to or less than 0.5, the arrangement being such so as to enhance for calibration setability among plural such injectors used in a given engine fuel injection system.

For a better understanding of the invention, as well as other objects and features thereof, reference is had to the following detailed description of the invention to be read with the accompanying drawings.

DESCRIPTION OF THE EMBODIMENT

Although a thin orifice director plate in accordance with the invention can be used in either a mechanical or electromagnetic fuel injector, for purpose of this disclosure it is illustrated as used in an electromagnetic fuel injector.

Figure 1:
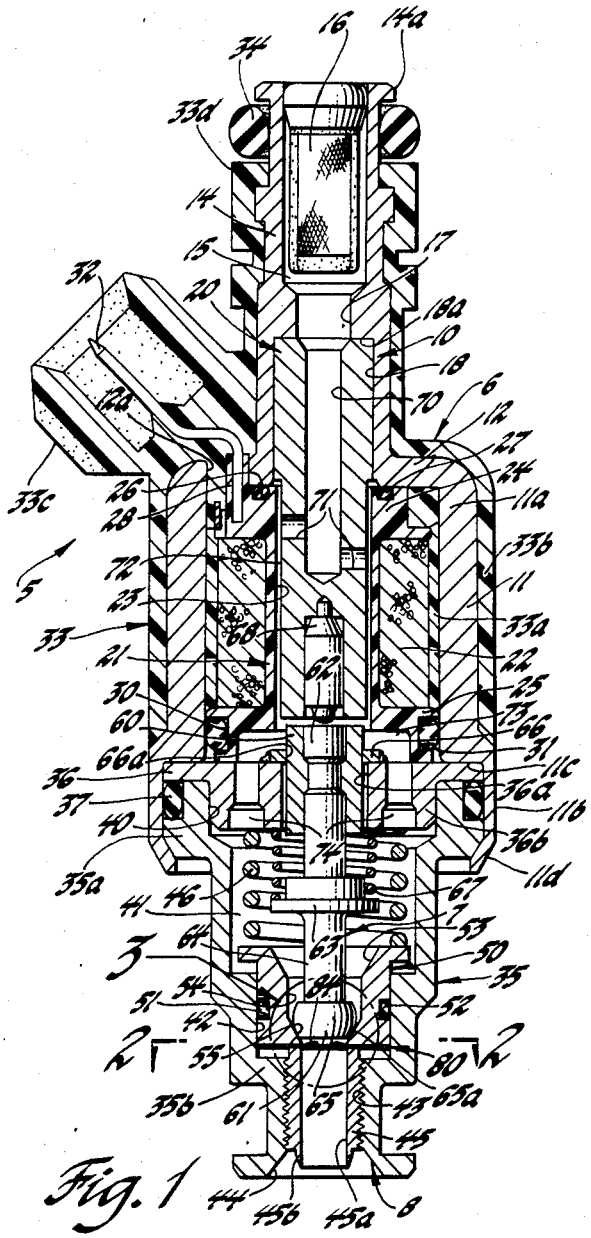
FIG. 1 is a longitudinal, cross-sectional view of an electromagnetic fuel injector with a thin orifice director plate in accordance with a preferred embodiment of the invention incorporated therein, the stop pin and valve member being shown in elevation.

Accordingly, referring first to FIG. 1 there is illustrated an electromagnetic fuel injector, generally designated 5, with a thin orifice director plate in accordance with a preferred embodiment of the invention incorporated therein. The electromagnetic fuel injector 5 is of a type similar to that disclosed in U.S. Pat. No. 4,423,842 entitled "Electromagnetic Fuel Injector with Self Aligned Armature" issued Jan. 3, 1984 to James D. Palma, but having a top fuel inlet in lieu of the bottom feed shown in this U.S. Pat. No. 4,423,842, and includes, as major components thereof, an upper solenoid stator assembly 6, an intermediate armature/valve member 7 and a lower nozzle assembly 8.

The solenoid stator assembly 6 includes a solenoid body 10 having a lower, rim-like, circular body 11, an integral flange portion 12 extending radially inward from the upper body 11 and terminating at an upstanding, tubular inlet tube portion 14. As shown, the body 11 includes an upper body portion 11*a* and a lower body portion 11*b*, the latter having both a greater internal diameter and outer diameter than the respective diameter of the upper portion and an interconnecting internal flat shoulder 11*c*. The upper portion 11*a* of body 11 is provided with a pair of opposed radial ports, not shown, for a purpose to be described hereinafter. Also as shown, the flange 12 is provided with an arcuate opening 12*a* for a purpose to be described hereinafter.

The inlet tube portion 14 of the solenoid body 10 at its upper end, with reference to FIG. 1, is adapted to be suitably connected, as by a fuel rail to a source of low pressure fuel and is provided with a stepped bore that extends axially therethrough so as to define, starting from its upper end an inlet fuel chamber 15 having a fuel filter 16 mounted therein, an axial inlet passage 17, and a pole piece receiving bore wall 18 of a predetermined internal diameter to receive, as by a press fit, the upper enlarged diameter end portion of a stepped diameter pole piece 20 with the upper end of this pole piece being located so that it will abut against the internal shoulder 18*a* of the inlet tube portion 14.

The solenoid stator assembly 6 further includes a spool-like, tubular bobbin 21 supporting a wound wire solenoid coil 22. The bobbin 21, made, for example, of a suitabe plastic material such as glass filled nylon, is provided with a central through bore 23, of a diameter so as to loosely encircle the lower reduced diameter end of the pole piece 20, and with upper and lower flange portions 24 and 25 respectively.

The upper flange 24, in the construction shown, is of stepped external configuration as shown in FIG. 1 and is provided with an annular groove 26 in its upper surface to receive a seal ring 27 for sealing engagement with the lower surface of the flange 12 and tube portion 14, and radially outboard of the groove 26 is an upstanding boss 28 that projects up through the arcuate opening 12*a* in the flange 12. The bottom flange 25 is provided with an annular groove 30 in its outer peripheral surface to receive a seal ring 31 for sealing engagement with the internal surface of the upper body portion 11*a*.

A pair of terminal leads 32, only one being shown in FIG. 1, are each operatively connected at one end to the solenoid coil 22 and each such lead has its other end extending up through the boss 28 for connection to a suitable controlled source of electrical power, as desired.

Preferably, the axial extent of bobbin 21 is preselected relative to the internal axial extent of the upper body portion 11*a* of the solenoid housing 10 between the lower surface of flange 12 and the shoulder 11*c* so that when the bobbin 21 is positioned in the solenoid housing 10, as shown in FIG. 1; an axial clearance will exist between the lower face of the bottom flange 25 of the bobbin 21 and the shoulder 11*c* of the solenoid housing 10, for a purpose to become apparent hereinafter.

Bobbin 21 is supported within the solenoid housing 10 by means of an encapsulant member 33, made of a suitable encapsulant material, such as glass filled nylon, that includes a cylindrical portion 33*a* encircling the solenoid coil 22 and the outer peripheral edge of the upper flange 24 of the bobbin 21 and which is also in abutment against the inner surface of the upper body portion 11*a* of body 11, a plurality of radial or axial extending bridge connectors, not shown, corresponding in number to the apertures, not shown, in the upper body portion, an outer cup-shaped outer shell 33*b* encircling the exterior upper portion 11*a* of body 11, and covering the exterior of flange 12 of the solenoid body 10, a stud 33*c* partly enclosing the terminal leads 32 and, a cylindrical portion 33*d* which encircles the inlet tube portion 14 with the upper surface of this latter portion terminating in spaced relationship to the lower surface of the flange 14*a* of the inlet tube portion 14 so as to, in effect, form therewith an annular groove for an O-ring seal 34.

The nozzle assembly 8 includes a nozzle body 35 of tubular configuration having a stepped upper flange 35*a* with an externally stepped lower body 35*b* of reduced external diameters depending therefrom.

The nozzle body 35 is fixed to the solenoid housing 10, with a separate stepped spacer disk 36 sandwiched between the upper surface of the nozzle body 35 and the shoulder 11*c*, as by inwardly crimping or swaging the lower end of the body portion 11*b* to define a radially inward extending rim flange 11*d*. Since, as previously described, the axial extent of bobbin 21 is preselected to provide an axial clearance between the lower surface of its flange 25 and shoulder 11*c*, the spacer disk 36 will abut against this shoulder. Also as shown, the upper flange 35*a* is undercut so as to define a groove to receive a seal ring 37 to effect a sealed connection between the nozzle body 35 and the internal wall of the lower body portion 11*b*.

Nozzle body 35 is provided with a central stepped bore to provide a circular, internal upper wall 40 of a diameter to slidably receive the depending hub portion 36*b* of the spacer disk 36, an intermediate upper wall defining a spring/fuel supply cavity 41, an intermediate lower wall defining a valve seat receiving cavity 42, a lower internally threaded wall 43 terminating in a radially outward flared discharge wall 44.

The nozzle assembly 8 further includes a tubular spray tip 45, having an axial discharge passage 45*a* therethrough, that is adjustably threaded into the internally threaded wall 43 of the nozzle body 35, suitable opposed flats 45*b* being provided on the outlet end of the spray tip to effect rotation thereof, as by a suitable wrench. At its upper end, the spray tip 45 axially supports a preferred embodiment of a thin orifice director plate, designated 80, in accordance with the invention to be described in detail hereinafter, which is loosely received in the cavity 42.

Figure 3:
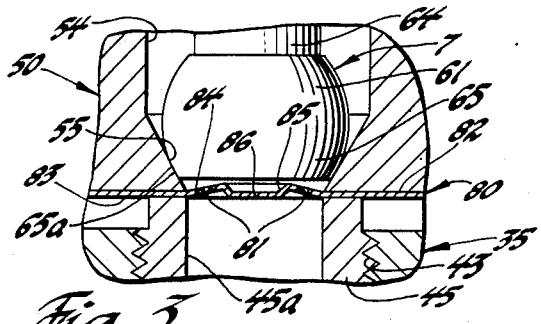
FIG. 3 is an enlarged view of the valve, valve seat, thin orifice director plate and the discharge portion of the arrowed encircled area 3 of FIG. 1.
Figure 4:
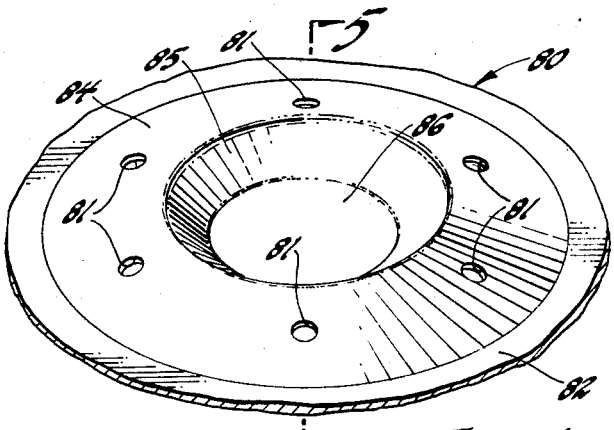
FIG. 4 is an enlarged perspective view of the angled and orifice passage portion of the thin orifice director plate, per se, of FIG. 2.

The thin orifice director plate 80 is held in abutment against the upper end of the spray tip 45 by means of a valve seat element 50, also loosely received in the cavity 42 and which is normally biased in an axial direction toward the spray tip 45, downward with reference to FIGS. 1 and 3, by a coiled spring 46, one end of which abuts against the valve seat element 50 while its opposite end abuts against the spacer disk 36.

Preferably as shown, the valve seat element 50 is provided with an annular groove 51 about its reduced diameter outer peripheral surface to receive a ring seal 52 that sealingly abuts against the wall 42. The valve seat element 50 is also provided with a stepped axial bored passage defined by an upper radially inward inclined wall 53, a straight intermediate wall 54 terminating in a radially inward inclined wall defining an annular frusto-conical valve seat 55.

Referring now to the armature valve member 7, it includes a tubular armature 60 and a valve element 61, made for example of stainless steel, that includes a stepped upper shank 62, an intermediate radial stepped flange 63 with a shank 64 depending therefrom that terminates at a valve 65 which is of semi-spherical configuration and of a predetermined radius with its lower truncated end portion defining a valve seating surface 65*a* for seating engagement with the valve seat. The armature 60 is suitably fixed to the upper shank 62 of the valve element, as by being crimped thereon, and is formed with a predetermined outside diameter so as to be loosely slidable through the central bored aperture 36*a* provided in the spacer disk 36.

The armature 60 is guided for axial movement by means of a guide washer 66, having a guide bore wall 66*a* of predetermined internal diameter, that is fixed, as by welding, to the spacer disk 36 concentrically around the aperture 36*a* therethrough.

The valve 65 of valve element 61 is normally biased into seating engagement with the valve seat 55 by a valve return spring 67 of predetermined force which loosely encircles the upper shank of the valve element. As shown, one end of the valve return spring 67 is centered by and abuts against the flange 63 of the valve element 61 while its opposite end abuts against the lower surface of the spacer disk 36.

The axial extent of the armature/valve member 7 is preselected such that when the valve 65 is seated against the valve seat 55, a predetermined working air gap exists between the opposed working surfaces of the armature 60 and the pole piece 20. However, a fixed minimum working air gap between these opposed working surfaces is maintained by means of a stop pin 68 suitably fixed, as by a press fit, into a blind bore provided in the lower end of the pole piece 20, with the lower end of the stop pin 68 extending a predetermined axial distance downward from the lower working surface of the pole piece 20 whereby to engage the armature/valve member 7 to thus limit its upward travel in a valve open position.

The pole piece 20, as shown in FIG. 1, is also provided with a blind bore defining an inlet passage portion 70 which at one end is in flow communication with the inlet passage 17 and which adjacent to its other or lower end is in flow communication via radial ports 71 with an annulus fuel cavity 72 formed by the diametrical clearance between the reduced diameter lower end of the pole piece 20 and the bore wall 23 of bobbin 21. Fuel cavity 72 is, in turn, in flow communication with the annular recessed cavity 73 provided in the lower flange 25 end of the bobbin 21 and via through passages 74 in the spacer disk 36 located radially outward of the guide washer 66 with the spring/fuel cavity 41.

Referring now to the subject matter of this invention, the thin orifice director plate 80, made of a suitable material such as stainless steel, in accordance with the preferred embodiment shown in FIGS. 1–5, is of circular configuration and with a central axis, which axis, as this director plate 80 is mounted in the injector 5, is substantially coaxial with the reciprocating axis of the armature/valve member 7. Located about a bolt circle of predetermined diameter positioned concentric to the central axis of this director plate 80 are a plurality of circumferentially, equally spaced apart through flow orifices 81 of predetermined diameter, six such flow orifices being used in the construction shown, with each of these flow orifices being formed at right angles to portion 84 of the opposed upstream and downstream surfaces 82 and 83, respectively, of the director plate in terms of the direction of fluid flow.

Figure 5:
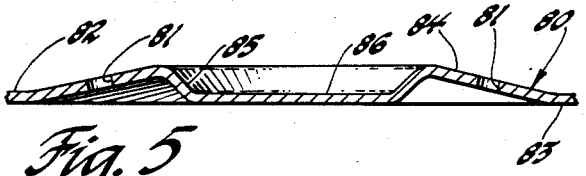
FIG. 5 is an enlarged sectional view of the angled and orifice passage portion of the thin orifice director plate taken along line 5—5 of FIG. 4.
Figure 2:
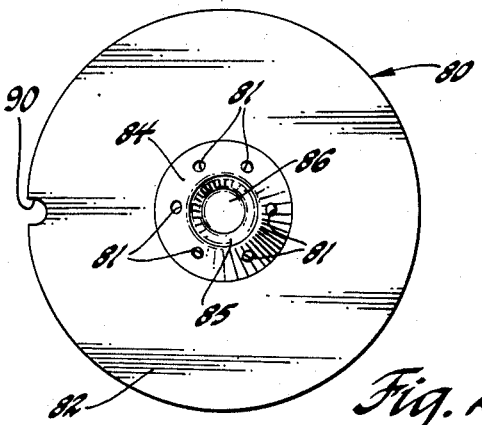
FIG. 2 is an enlarged top view of the thin orifice director plate, per se, of FIG. 1 taken along line 2—2 of FIG. 1.

Now in accordance with a feature of the invention, in order to direct the fuel streams discharged through this flow orifice either radially away from the central axis or radially toward the central axis, as shown in the construction illustrated, the material surrounding these flow orifices 81 is angled out of the normal, horizontal plane, with reference to FIGS. 1, 3 and 5, of the main portion of the director plate 80. In the construction shown in FIGS. 1–5, this angled surface portion 84 is upset upward of the normal plane of the director plate 80, it of course being realized that, if desired, the angled surface can be upset downward in a manner similar to that shown in FIGS. 6 and 7 with reference to an alternate embodiment of the subject thin orifice director plate.

The angled surface portion 84 of the thin orifice director plate 80, in the embodiment shown in FIGS. 1–5, is of an annulus configuration that is formed with inner and outer diameters spaced a predetermined radial distance, as desired, inward and outward, respectively, of the ring of flow orifices 81, with the inner diameter portion of this annulus shaped angled surface portion being connected by a reverse bend, annulus angled portion 85 to a central disk portion 86 that lies in the normal plane of the main body portion of the director plate 80.

The angled surface portion 84 is angled out of the normal plane of the flat main body portion of the director plate 80 at a suitable predetermined number of degrees, as desired, whereby the axis of each of the flow orifices 81 is inclined so that the jet of fuel discharged through such flow orifice is directed into the discharge passage 45*a* of the spray tip 45 at a predetermined angle relative to the central axis of the director plate 80 and thus at a corresponding angle relative to the central axis of the discharge passage 45*a* and considering the axial extent of this discharge passage 45*a* so as to obtain a fuel spray pattern as desired.

As an example, on a particular thin orifice director plate 80 as used in the port fuel injection system in a particular engine application, the angle of inclination of the angled surface portion 84 relative to the normal plane of the main body portion of the director plate 80 was 10°, as shown in FIG. 5.

With reference to the embodiment of the thin orifice director plate 80 shown in FIGS. 1–5 wherein the axes of the flow orifices 81 are inclined so as to direct fuel flow toward the axis of the discharge passage 45*a* in the spray tip 45, these flow orifices 81 can be angularly located so that the axis of each flow orifice 81 is radially aligned relative to the central axis of the thin orifice director plate 80 and thus with the axis of the discharge passage 45*a* so as to produce a pencil stream of discharged fuel.

Alternatively, as disclosed in copending U.S. patent application Ser. No. 730,462 filed concurrently herewith in the names of Jay K. Sofianek, John F. Nally, James H. Rush, Robert L. Fuss, John E. Williams and Allan M. Ruckey and assigned to a common assignee, the flow orifices 81 can be angularly located, in a manner as shown in the FIG. 6 embodiment, so that the axis of each such flow orifice 81 is angularly located in either a clockwise or counterclockwise direction, with reference to FIG. 2, relative to vertical planes intersecting the central axis of the director plate 80 so as to produce a hollow conical spray pattern.

In addition, the number of such flow orifices 81 and the diameter thereof are preselected, as desired, whereby the total cross-sectional flow area of these flow orifices 81 is substantially less than the flow areas upstream and downstream thereof, including the flow area defined between the valve seat 55 and the valve 65 when the latter is in a full open position relative to the valve seat 55.

The nominal thickness of the director plate 80 at the flow orifices 81 is also selected relative to the diameter of the flow orifices 81 so that L/D is equal to or less than 0.5, wherein L is the length of flow orifice and D is the diameter of the flow orifice. Thus by way of an example, in the particular thin orifice director plate 80 referred to hereinabove, the director plate was 0.05 mm thick and the diameter of each of the flow orifices was 0.16 mm giving an L over D or 0.05/0.16 ratio of 0.3125 since the axes of the flow orifices are formed at right angles through the opposed surfaces of the angled portion 84 of 0.05 mm thickness.

With the thin orifice director plate structure described, this orifice director plate 80, as used in the electromagnetic fuel injector 5 at a location downstream of the larger valve seat 55/valve 65 orifice, will be the element controlling static flow from the injector.

Figure 6:
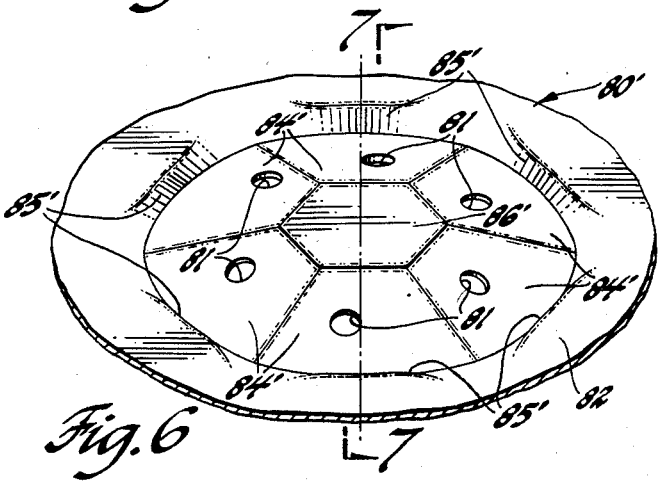
FIG. 6 is an enlarged perspective view, similar to FIG. 4, of an alternate embodiment thin orifice director plate in accordance with the invention; and, FIG. 7 is an enlarged sectional view of the angled and orifice portion of the thin orifice director plate of FIG. 6 taken along line 7—7 of FIG. 6.
Figure 7:
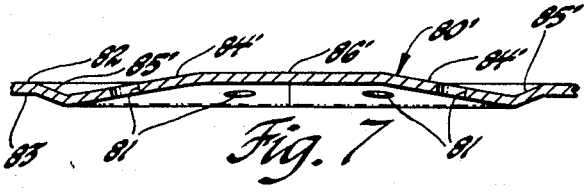

An alternative embodiment of a thin orifice director plate, generally designated 80' in accordance with the invention is shown in FIGS. 6 and 7 wherein similar parts are designated by similar numerals but with the addition of a prime (') where appropriate. The thin orifice director plate 80', also formed with six flow orifices 81, in this alternate embodiment is provided accordingly with six separate angled portions 84', upset downward at a predetermined angle relative to the normal plane of the main body portion of this director plate so as to give this somewhat central area of the director plate a truncated, regular hexagonal pyramid configuration.

In this alternate embodiment, the radial inward edge of each angled portion 84' merges into a central hex disk portion 86' that lies in the normal plane of the main body portion of the director plate 80' while the radial outward edge of each angled portion 84' being connected by reverse bend angled portions 85' to the radial outward main body portion of the director plate 80'.

Although each embodiment of the multiple orifice director plates in accordance with the invention have been described and illustrated as orientated so as to produce converging plumes of fuel discharge, it will be apparent that these director plates can be inverted within the injector so as to produce a diverging spray pattern.

A thin multiple orifice director plate in accordance with the invention can be inexpensively manufactured, for example, using a progressive die, in which case, as shown for example in FIG. 6, the director plate 80' is provided with an indexing notch 90. As will be appreciated, the holes defining the flow orifices can be formed in any suitable manner as known in the art. Alternatively, the subject multiple orifice director plate can be produced by an electro forming process which is a plating process where the material builds upon a negatively shaped surface to form the subject thin, multiple orifice director plate. The thin orifice director plate of the invention offers both an advantage in manufacture, as described, and functional advantages. The functional advantages are as follows:

I. Fuel Spray Cone Quality

A. Individual Fuel Jet Targeting

The formed multiple thin orifice director plate equals a director plate with long orifice's fuel jet targeting ability using the angled thin orifices rather than the long angled orifice holes.

B. Fuel Atomization

The formed thin multiple orifice director plate atomizes the fuel producing only small fuel droplets. The long orifice, however, forms large droplets within its spray cone. Fuel jet turbulence from internal long orifice fluid cavitation causes the large droplet formation. The fluid dynamic nature of the thin orifice produces no similar internal cavitation. Testing confirms the superior fuel atomization of the formed multiple thin orifice director plate over known thick orifice director plates.

C. Constant Fuel Jet Exit Velocity

The thin orifice's fuel jet exit velocity remains constant under constant fuel pressure. Conversely, the long orifice's fuel jet turbulence causes exit fuel velocity oscillation. The thin orifice's fuel spray cone stays more uniformly shaped with constant exit fuel velocity than the long orifice with oscillating fuel jet velocity.

II. Fuel Metering (Mass Flow Rate)

The formed subject multiple thin orifice director plate meters fuel accurately, repeatably, and without hysteresis. Fuel Pressure Control fuel injection systems rely upon predictable fuel metering under controlled fuel pressure. Fuel pressure vs. mass fuel flow test data confirms that the formed subject multiple thin orifice director has a square root slope. Since the formed multiple thin orifice director's mass fuel flow rate is mathematically predictable, then a computer controlled fuel injection system can accurately meter fuel. So the physical nature of the thin orifice coupled with the formed spray cone inducing surface of the subject invention provides a valuable fuel injector fuel metering director.

Test Results of "Thin" Orifice Director Plate vs. "Thick" Orifice Director Plate

| | Orifices | | |
|---|---|---|---|
| | Thin | | Thick |
| A. Repeatability: consecutive tests, same part | (1% | vs. | 8%) |
| B. Accuracy: consecutive parts | (3% | vs. | 30%) |
| C. No hysteresis: increasing vs. decreasing to a pressure | (1% | vs. | 17%) |
| D. Square Root Slope (Pressure vs. Fuel Flow) (Fluid Dynamic's theory can accurately predict fuel flow.) | | | |

While the invention has been described with reference to the structures disclosed herein, it is not confined to the specific details set forth, since it is apparent that modifications and changes can be made by those skilled in the art. For example, the angled surface portion around each flow orifice can be formed as separate embossments of any desired configuration, such as a single semi-spherical embossment, multiple semi-spherical embossments as in a clover-leaf pattern or in a four sided pyramidal pattern and the arrangement of the flow orifices can also be arranged as desired, for example, in a single semi-spherical embossment structure, plural flow orifices could be arranged in a straight row so as to produce a fan-shaped spray pattern which could be either converging or diverging depending on the direction of flow of fuel through the flow orifices. This application is therefore intended to cover such modifications or changes as may come within the purposes of the improvement or scope of the following claims.

The embodiments of the invention in which an exclusive property or privilege is claimed are defined as follows:

1. An orifice director plate for use in an electromagnetic fuel injector of the type used in the fuel injection system for an internal combustion engine, said orifice director plate including a disk in the form of a body of revolution about an axis and of a predetermined thickness an having opposed surfaces, a plurality of equally spaced apart, circular, through orifice passages located on a circumference of a base circle positioned concentric to said axis and aligned at right angles to said opposed surfaces, and the material of said disk surrounding each of said orifice passages being angled out of the normal plane of said disk so that said orifice passages are inclined at a predetermined angle to said axis.

2. A thin orifice director plate for use in an electromagnetic fuel injector of the type used in the fuel injection system for an internal combution engine, said thin orifice director plate including a disk in the form of a body of revolution about an axis and having a predetermined thickness with configuration with opposed surfaces, a plurality of equally space apart, circular, through orifice passages located on a circumference of a base circle positioned concentric to said axis and aligned at right angles to said opposed surfaces, the material of said disk surround each of said orifice passages being angled out of the normal plane of said disk so that said orifice passages are inclined at a predetermined angle to said central axis and, the thickness of said disk and the diameters of said orifice passages being selected to provide an L (length of passage)/D (diameter of passage) ratio that is not greater than 0.5.

3. An electromagnetic fuel injector of the type having a thin orifice director plate located downstream of the solenoid actuated valve and valve seat elements thereof, said thin orifice director plate including a disk of circular configuration with opposed surfaces and with a central axis, a plurality of equally spaced apart, circular, through orifice passages located on a circumference of a base circle positioned concentric to said central axis and aligned at right angles to said opposed surfaces, the material of said disk surrounding each of said orifice passages being angled out of the normal base plane of said disk so that said orifice passages are inclined at a predetermined angle to said central axis to direct fuel flow relative thereto and, the thickness of said disk and the diameters of said orifice passages being such so as to provide an L (length of passage)/D (diameter of passage) ratio of 0.5 or less.

* * * * *